US011000719B2

(12) United States Patent
Stefan et al.

(10) Patent No.: US 11,000,719 B2
(45) Date of Patent: May 11, 2021

(54) METHOD FOR IMMOBILIZING A MERCURY-CONTAINING WASTE

(71) Applicants: ORANO CYCLE, Courbevoie (FR); INSTITUT FRANÇAIS DES SCIENCES ET TECHNOLOGIES DES TRANSPORTS, DE L'AMÉNAGEMENT ET DES RÉSEAUX, Marne-la-Vallée (FR)

(72) Inventors: Lavinia Stefan, Saint-Germain-en-Laye (FR); Thierry Chaussadent, Paris (FR); Nadia Dominique, Paris (FR)

(73) Assignees: ORANO DÉMANTÈLEMENT, Courbevoie (FR); INSTITUT FRANÇAIS DES SCIENCES ET TECHNOLOGIES DES TRANSPORTS, DE L'AMÉNAGEMENT ET DES RÉSEAUX, Marne-la-Vallée (FR)

( * ) Notice: Subject to any disclaimer, the term of this patent is extended or adjusted under 35 U.S.C. 154(b) by 331 days.

(21) Appl. No.: 16/312,516

(22) PCT Filed: Jun. 29, 2017

(86) PCT No.: PCT/FR2017/051752
§ 371 (c)(1),
(2) Date: Dec. 21, 2018

(87) PCT Pub. No.: WO2018/002540
PCT Pub. Date: Jan. 4, 2018

(65) Prior Publication Data

US 2019/0336806 A1 Nov. 7, 2019

(30) Foreign Application Priority Data

Jun. 29, 2016 (FR) ..... 1656083

(51) Int. Cl.
*A62D 3/33* (2007.01)
*A62D 101/24* (2007.01)
*A62D 101/43* (2007.01)

(52) U.S. Cl.
CPC ..... *A62D 3/33* (2013.01); *A62D 2101/24* (2013.01); *A62D 2101/43* (2013.01)

(58) Field of Classification Search
CPC ... A62D 3/33; A62D 2101/24; A62D 2101/43
USPC ..... 588/315
See application file for complete search history.

(56) References Cited

U.S. PATENT DOCUMENTS

| | | | |
|---|---|---|---|
| 5,173,286 | A | 12/1992 | Audeh |
| 6,312,499 | B1 | 11/2001 | Rehmat et al. |
| 2008/0019900 | A1 | 1/2008 | Riviere-Huc et al. |
| 2008/0234529 | A1 | 9/2008 | Chan et al. |

FOREIGN PATENT DOCUMENTS

| | | | |
|---|---|---|---|
| CN | 103736387 | A | 4/2014 |
| DE | 4123907 | A1 | 1/1993 |
| EP | 2072467 | A2 | 6/2009 |
| EP | 2476649 | A2 | 7/2012 |
| EP | 1751775 | B1 | 10/2012 |
| WO | 2005/014472 | A1 | 2/2005 |

OTHER PUBLICATIONS

International Search Report for PCT/FR2017/051752 dated Sep. 29, 2017.
Written Opinion for PCT/FR2017/051752 dated Sep. 29, 2017.
Preliminary French Search Report for FR 1656083 dated Feb. 23, 2017.
Chiriki, S., "Disposal strategy of proton irradiated mercury from high power spallation sources" INL Energy and Environment, 2010, vol. 67, 151 pages.
Cheeseman, C.R. et al., "Heavy Metal Leaching From Hydroxide, Sulphide and Silicate Stabilished/Solidified Wastes", In: Waste Management, 1993, vol. 13(8), pp. 545-552.
Hamilton, W.P. et al., "Determination of Acute Hg Emissions From Solidified/Stabilized Cement Waste Forms", in: Waste Management, 1997, vol. 17, No. 1, pp. 25-32.
Zhang, J. et al., "Stabilization/Solidification (S/S) of Mercury-Containing Wastes Using Reactivated Carbon and Portland Cement", In: Journal of Hazardous Materials, 2002, vol. B92(2), pp. 199-212.
Zhang, XY. "Stabilization/Solidification (S/S) of Mercury-Contaminated Hazardous Wastes Using Thiol-Functionalized Zeolite and Portland Cement", In: Journal of Hazardous Materials, 2009, vol. 168(2-3), pp. 1575-1580.
Ullah, M.B., "Mercury Stabilization Using Thiosulfate and Thioselenate", A Thesis submitted in partial fulfillment of the requirements for the degree of master of applied science, The University of British Columbia, Apr. 2012, 73 pages.

*Primary Examiner* — Edward M Johnson
(74) *Attorney, Agent, or Firm* — Pearne & Gordon LLP

(57) ABSTRACT

A process for immobilizing a mercury-containing waste, which comprises: —stabilizing the mercury of the waste by precipitating the mercury as mercury (II) sulfide; then —encapsulating the waste by cementation, the cementation comprising coating the waste in a cement paste obtained by mixing a composition comprising a powder of at least one binder chosen from hydraulic cements, alkali-activated cements and acid-activated cements, with an aqueous mixing solution, then hardening the cement paste; and which is characterized in that the precipitation of the mercury as mercury (II) sulfide is obtained by reacting the mercury with a thiosulfate in a basic aqueous medium, while stirring and in the presence of a sulfide of an alkali metal, the molar ratio of the thiosulfate to the mercury being at least equal to 1.

20 Claims, 3 Drawing Sheets

METHOD FOR IMMOBILIZING A MERCURY-CONTAINING WASTE

CROSS-REFERENCE TO RELATED APPLICATIONS

This is a National Stage application of PCT international application PCT/FR2017/051752, filed on Jun. 29, 2017, which claims the priority of French Patent Application No. 16 56083, filed Jun. 29, 2016, both of which are incorporated herein by reference in their entireties.

TECHNICAL FIELD

The invention relates to the field of immobilization of wastes comprising mercury, also referred to as mercury wastes.

More specifically, the invention relates to a method for immobilizing a waste comprising mercury, which comprises the stabilization of this mercury by precipitation in the form of mercury(II) sulfide (or mercuric sulfide), having the formula HgS and which is referred to more simply as "mercury sulfide" in the following sections, then followed by the encapsulation by means of cementation, that is to say by means of embedding in a cementitious matrix, the waste comprising the mercury sulfide thus obtained.

The invention in particular finds application in the immobilization of mercury wastes originating from nuclear facilities and, therefore, contaminated or potentially contaminated with radioelements.

However, it goes without saying that it has the ability to be effectively used for immobilizing any mercury waste regardless of the origin thereof.

STATE OF THE PRIOR ART

Mercury is a toxic metal that is in liquid form under normal conditions of temperature and pressure. It is a very volatile element that vaporises easily at ambient temperature by forming vapours which are all the more pernicious being that they are colourless and odourless.

Mercury is present in many devices such as batteries, accumulators, fluorescent tubes and low-energy bulbs (or compact fluorescent bulbs) which are used in particular in nuclear facilities, in which case it is associated with nuclear waste. It is also used in the chemical industry as a liquid cathode in electrolysis cells. Finally, it is used in the manufacture of metal amalgams and, in particular, dental amalgams.

According to the French National Plan for the Management of Materials and Radioactive Wastes (PNGMDR) established pursuant to the provisions of Law No. 2006-739 dated 28 Jun. 2006, of the French Republic, relating to the sustainable management of radioactive materials and wastes, mercury and mercury wastes, along with asbestos wastes, organic fluids and oils, are part of wastes for which there does not at the present time exist a waste management chain, that is to say for which there does not yet exist a waste disposal chain.

Taking into account the aforementioned toxicity and volatility of mercury, direct storage or incineration of mercury and mercurial wastes is not an option that can be envisaged.

This is why processes and methods aimed at reducing the mobility of mercury in the environment have been proposed.

These immobilization methods are essentially aimed at preventing the mercury from being released into the atmosphere, by volatilisation, and into the ground or soil, by leaching.

The methods for immobilization are amalgamation, stabilization and encapsulation.

Amalgamation is the physical immobilization of mercury by dissolution in another metal in order to form an amalgam or semi-solid alloy. Thus, for example, the U.S. Pat. No. 6,312,499 (hereinafter referenced as [1]) proposes an amalgamation with copper, with a minimum of 50% by weight of mercury in the amalgam.

The problem with this technique is that it does not reduce the risks of volatilisation and leaching of the mercury. The amalgamation must therefore be followed by an encapsulation, for example in a cementitious matrix as described in the patent application US 2008/0234529 (hereinafter referenced as [2]), in which case the mercury, even if amalgamated, can easily be volatilise under the effect of any increase in temperature such as the one which induced by the hydration of the cement used for the encapsulation.

Stabilization is the chemical immobilization of mercury by combination thereof with suitable chemical species. The stabilization of mercury most commonly proposed in the literature is the process consisting of inducing the reaction of mercury with sulfur in order to form mercury sulfide.

It is thus that stabilization methods by dry processes and stabilization methods by wet processes have been proposed.

The stabilization methods by dry processes are, for example, those described in the patent applications EP 1 751 775, EP 2 072 467 and EP 2 476 649 (hereinafter referenced as [3], [4] and [5] respectively). These methods have in common processes whereby the mercury is induced to react with sulfur in the solid state, in a reactor having a specific structure (reference [3]), a mixer (reference [4]), or a planetary ball mill (reference [5]), and to result in a product that comprises mercury sulfide crystallised in β form, which is black in colour and commonly referred to as "metacinnabar", in an admixture with sulfur (references [3] and [5]) or with mercury sulfide crystallised in α form, which is red in colour and commonly referred to as "cinnabar" (reference [4]).

The stabilization methods by wet processes consist in dissolving the mercury in a concentrated strong acid, such as nitric acid or hydrochloric acid, and adding to the resulting solution a sulfur source, such as sodium sulfide, potassium sulfide, or ammonium sulfide, in order to lead to the precipitation of mercury in the metacinnabar form. A method of this type has been described by S. Chiriki (*Schriften Forschungszentrums Jülich-Reihe Energie and Umwelt/Energy and Environment* 2010, 67, 151 pages, hereinafter referenced as [6]).

In the light of the results presented in this reference document, the wet stabilization technique appears to present the advantages of being simple to implement, in particular with the possibility of working in batches and thus limiting the amount of mercury to be precipitated—which is advantageous in terms of safety —, and of resulting in a mercury/sulfur reaction which is both rapid and complete.

On the other hand, this technique generates large quantities of effluents that are aqueous, acidic and contaminated with mercury. In addition, gaseous hydrogen sulfide, which is a gas being, on the one hand, dangerous and, on the other hand, capable of leading, during its formation and its passage into the atmosphere, to other elements that one may also want to stabilize, is likely to be released over the course of this type of stabilization.

Encapsulation is the physical immobilization of mercury by entrapment within an impermeable matrix.

For the encapsulation of mercury, several types of matrices have been studied including, in particular, cementitious matrices based on Portland cements or phosphomagnesium cements, and sulfur based polymer matrices.

These studies show that the cementation process is a route of interest for the physical immobilization of mercury because it makes it possible to obtain leaching levels that are situated below the regulatory thresholds permissible, provided that the mercury has already been stabilized beforehand, in particular into mercury sulfide (C. R. Cheeseman et al., *Waste Management* 1993, 13 (8), 545-552, hereinafter referenced as [7], W. P. Hamilton and A. R. Bowers, *Waste Management* 1997, 17 (1), 25-32, hereinafter referenced as [8]) or by means of adsorption on a trap such as activated charcoal (J. Zhang and P. Bishop, *Journal of Hazardous Materials* 2002, 92(2), 199-212, hereinafter referenced as [9], or a zeolite having thiol functional groups (X. Y. Zhang et al., *Journal of Hazardous Materials* 2009, 168 (2-3), 1575-1580, hereinafter referenced as [10]).

Recently, results from tests designed to stabilize mercury in the form of mercury sulfide by reaction with sodium thiosulfate have been reported by M. B. Ullah (Thesis for Master of Applied Sciences 2012, University of British Columbia, 73 pages, hereinafter referenced as [11]). These results show that mercury reacts only very partially with sodium thiosulfate, with this being for pH values ranging from 6 to 12. Thus, only 10 to 15% of the mercury is attacked by the sodium thiosulfate after a period of 9 days of reaction therewith at a pH ranging from 6 to 10. At pH 12, the results are better, but the degree of mercury content that reacts with sodium thiosulphate is however only 50% after a period of 8 days of reaction. According to the author of these reported tests, the partial attack of mercury by sodium thiosulfate would lead to the precipitation of metacinnabar on the surface of the residual mercury, which would have the effect of then preventing this attack from being total. In any case, he concludes therefrom that a complete stabilization of mercury by sodium thiosulphate is impossible (see pages 35 and 52 of reference [11]).

However, in the context of their work on the development of a method for immobilizing mercury wastes, the inventors have found that, contrary to what reference [11] teaches, it is possible to precipitate mercury in the form of mercury sulfide, with a quantitative yield and within a time period that is compatible with an implementation on an industrial scale, by inducing the reaction of mercury with a thiosulfate in a basic aqueous medium, in particular at a pH of the order of 11-12, if this reaction is conducted in the presence of an alkali metal sulfide.

It is thus possible to completely stabilize the mercury present in a mercury waste by means of a wet process with mercury sulfide, with no production of hydrogen sulfide.

The inventors have also found that the embedding of the mercury sulfide thus obtained in cementitious pastes has little impact on the hydration of these cementitious pastes and on the mechanical properties of the materials resulting from the hardening thereof, which allows for a high degree of encapsulation of this mercury sulfide within the cementitious matrices and, consequently, for obtaining a reduced number of packaging parcels, for a given volume of mercury waste.

And it is therefore on these findings that the invention is based.

DISCUSSION OF THE INVENTION

The invention relates to a method for immobilizing a waste comprising mercury, which method comprises:

stabilizing the mercury present in the waste by precipitation of the mercury as mercury(II) sulfide; then encapsulating the waste by cementation, the cementation comprising embedding the waste in a cementitious paste obtained by mixing a composition comprising a powder of at least one binder selected from hydraulic cements, base-activated cements and acid-activated cements, with an aqueous mixing solution, then hardening the cementitious paste;

and is characterized in that the precipitation of the mercury as mercury(II) sulfide is obtained by reacting the mercury with a thiosulfate in a basic aqueous medium, under agitation and in the presence of an alkali metal sulfide, the molar ratio of the thiosulfate to the mercury in the aqueous medium being at least equal to 1.

Thus, according to the invention, the waste comprising mercury is immobilized by a method which includes two successive steps, namely:

a step for stabilizing the mercury that this waste contains by precipitation in the form of mercury sulfide, this precipitation having the characteristic features of being carried out in an alkaline medium, by reaction of the mercury with a thiosulfate in the presence of an alkali metal sulfide; and a step for encapsulating or conditioning (the terms "encapsulating" and "conditioning" being considered equivalent within the context of the invention) the waste containing the mercury sulfide thus precipitated in a cementitious matrix.

According to the invention, the stabilization of the mercury preferably comprises:

dispersing the waste in an aqueous solution of the thiosulfate under agitation and maintaining the resulting suspension under agitation until its pH, which is initially from 7 to 8 and which increases spontaneously due to the formation of compounds of the type $Hg(S_2O_3)$ and $Hg(S_2O_3)_2^{2-}$, reaches a value at least equal to 11; then adding, fractionated or not, the sulfide of an alkali metal, preferably in solid form, to the suspension under agitation, and maintaining the suspension under agitation until all the mercury has precipitated as mercury sulfide.

Although the molar ratio of the thiosulfate to the mercury present in the waste has a little effect on the duration and the yield of the precipitation so long as it is at least equal to 1, it is nevertheless preferred that the molar ratio of the mercury to the thiosulfate be equal to or greater than 2, typically comprised between 2 and 3 and, for example, of 2.5.

With regard to the molar ratio of the sulfide of an alkali metal to the mercury present in the waste, it is preferably at most equal to 1, and still better, less than 0.5, typically comprised between 0.1 and 0.3, and for example, of 0.2.

The thiosulfate used for the precipitation is advantageously a thiosulfate of an alkali metal and, more preferably, sodium thiosulfate ($Na_2S_2O_3$) or potassium thiosulfate ($K_2S_2O_3$) which are to be used preferentially in hydrated form.

However, it goes without saying that other thiosulphates also have the ability to be used as long as they are soluble in water (which is the case, for example, of magnesium thiosulfates $Mg_2S_2O_3$ and ammonium thiosulfates $(NH_4)_2S_2O_3$) and that their cation (whether metallic or otherwise) does not interfere with the other ions in solution thereby leading to the precipitation of undesired compounds.

As for the alkali metal sulfide which is used for the precipitation, it is advantageously sodium sulfide ($Na_2S$) or potassium sulfide ($K_2S$) which are also to be used preferably in hydrated form.

In a preferred embodiment of the method of the invention, the stabilization of the mercury comprises:

dispersing the waste in an aqueous solution of sodium thiosulfate or potassium thiosulfate under agitation, in a molar ratio of the thiosulfate to the mercury present in the waste of 2 to 3, for example of 2.5, and maintaining the resulting suspension under agitation for a period of 10 hours to 48 hours, for example of 24 hours;

adding a first quantity of sodium sulfide or potassium sulfide in solid form to the suspension under agitation, this quantity being such that the molar ratio of the sulfide to the mercury is from 0.05 to 0.15, for example of 0.1, and maintaining the suspension under agitation for a period of 10 hours to 48 hours, for example of 24 hours; then adding a second quantity of sodium sulfide or potassium sulfide in solid form to the suspension under agitation, this quantity being such that the molar ratio of the sulfide to the mercury is from 0.05 to 0.15, for example of 0.1, and maintaining the suspension under agitation for a period of 48 hours to 96 hours, for example of 72 hours.

As previously indicated, the binder used for the cementation may be selected, first of all, from the hydraulic cements.

The term "hydraulic cement" is understood to refer to a cement whose hardening is the result of the hydration by water of a finely milled material, constituted in whole or in part of a clinker, that is to say a product resulting from the firing of a mixture of limestone and clay. Thus, the term "hydraulic cement" does not include the so-called "geopolymer" cements whose hardening is the result of a polycondensation of a finely milled alumino-silicate material that is free of clinker, in an alkaline solution, or cements whose hardening is the result of a chemical reaction between the constituent material or materials of these cements and an acidic or basic solution (magnesium cements, alkali-activated slags, etc).

When the binder is selected from among hydraulic cements, it may then in particular be selected from:

cements classified as "CEM I" by the European standard NF EN 197-1, also referred to as "Portland cements", which comprise at least 95% by mass of a clinker cement and at most 5% by mass of secondary constituents;

cements classified as "CEM II" by the aforementioned standard, also referred to as "Portland composite cements", which comprise at least 65% by mass of a clinker cement, at most 35% by mass of a component selected from a blast furnace slag, a silica fume, a natural pozzolana, a calcined natural pozzolana, calcic or siliceous fly ash, a calcined shale or a limestone, and at most 5% by mass of secondary constituents;

cements classified as "CEM Ill" by the aforementioned standard, also referred to as "blast furnace cements", which comprise from 5% to 64% by mass of a clinker, from 36% to 95% by mass of a blast furnace slag and at most 5% by mass of secondary constituents;

cements classified as "CEM IV" by the aforementioned standard, also referred to as "pozzolanic cements", which comprise from 45% to 89% by mass of a clinker, from 11% to 55% by mass of a component selected from a silica fume a natural pozzolana, a calcined natural pozzolana, calcic or siliceous fly ash, and at most 5% by mass of secondary constituents; and cements classified as "CEM V" by the aforementioned standard, also referred to as "composite cements", which comprise from 20% to 64% by mass of a clinker, from 18% to 50% by mass of a blast furnace slag, from 18% to 50% by mass of fly ash, and at most 5% by mass of secondary constituents.

These cements are in particular available from LAFARGE, HOLCIM, HEIDELBERGCEMENT, CEMEX, ITALCEMENTI and its subsidiary CALCIA.

The binder may also be selected from base-activated cements and, in particular, from vitrified blast-furnace slags, in which case it may be any slag deriving from the production of cast iron in the blast furnace and obtained either by vitrification under water (granulated slag) or by air vitrification or "pelletising" (pelletised slag). This type of slag is typically composed of from 38% to 48% by mass of calcium oxide (CaO), from 29% to 41% by mass of silica ($SiO_2$), from 9% to 18% by mass of alumina ($Al_2O_3$), from 1% to 9% by mass of magnesia (MgO), and at most 3% by mass of secondary constituents. By way of example of such a slag, mention may be made of the ground granulated blast furnace slag produced by the company ECOCEM.

The binder may also be selected from acid-activated cements and, in particular, from phosphomagnesium cements, that is to say cements that are composed of an oxidized magnesium source, that is to say in the oxidation state +II, this source being typically a magnesium oxide (MgO) calcined at high temperature (of "hard burnt" or "dead burnt" type), either pure or presenting impurities of the type $SiO_2$, CaO, $Fe_2O_3$, $AlO_3$, etc., and a phosphate source soluble in water, this source being typically a phosphoric acid salt.

The phosphomagnesium cement that may be used in the invention may be any phosphomagnesium cement known to the person skilled in the art. However, it is preferred that this cement be composed of:

a magnesium oxide such as those marketed by the company RICHARD BAKER HARRISON under the product references DBM 90 and DBM 95; and a phosphoric acid salt such as ammonium phosphate ($(NH_4)_3PO_4$), diammonium hydrogen phosphate ($(NH_4)_2HPO_4$), ammonium dihydrogen phosphate ($NH_4H_2PO_4$), ammonium polyphosphate ($(NH_4)_3HP_2O_7$), aluminium phosphate ($AlPO_4$), aluminium hydrogen phosphate ($Al_2(HPO_4)_3$), aluminium dihydrogen phosphate ($Al(H_2PO_4)_3$), sodium phosphate ($Na_3PO_4$), sodium hydrogen phosphate ($Na_2HPO_4$), sodium dihydrogen phosphate ($NaH_2PO_4$), potassium phosphate ($K_3PO_4$), potassium hydrogen phosphate ($K_2HPO_4$), potassium dihydrogen phosphate ($KH_2PO_4$), etc., with preference being given to potassium dihydrogen phosphate, and this, with a Mg/P molar ratio which is preferentially comprised between 1 and 12 and, still better, between 5 and 10.

Finally, the binder may also be composed of a mixture of one or more hydraulic cements and/or one or more base-activated cements.

According to the invention, the binder is advantageously selected from CEM I, CEM II, CEM III, CEM V cements, vitrified blast furnace slags, mixtures thereof, and phosphomagnesium cements and, still better, from CEM I cements and phosphomagnesium cements.

Depending on the nature of the binder (hydraulic cement, base-activated cement or acid-activated cement), the aqueous mixing solution may be of neutral pH, basic (in which case this solution preferably comprises a strong base of the sodium hydroxide or potassium hydroxide type, preferentially at a concentration of at least 1 mol/L) or acidic (in which case this solution preferably comprises a phosphoric acid salt such as those mentioned previously above).

In addition to including the binder powder and the aqueous mixing solution, the composition may comprise at least one adjuvant selected from plasticisers (water-reducing or not), superplasticisers, setting retarders and compounds that combine several effects such as superplasticisers/setting retarders, depending on the properties of workability, setting and/or hardening that it is desired to confer to the cementitious paste.

In particular, the composition may comprise a superplasticiser and/or a setting retarder.

Superplasticisers that are likely to be suitable are, in particular, high water-reducing superplasticisers of the polynaphthalene sulphonate type, such as the one available from the company BASF under the product reference Pozzolith™ 400N, whereas setting retarders that are likely to be suitable, in particular are hydrofluoric acid (HF) and especially salts thereof (sodium fluoride for example), phosphoric acid ($H_3PO_4$) and salts thereof (sodium phosphate for example), boric acid ($H_3BO_3$) and salts thereof (sodium borate of borax type for example), citric acid and salts thereof (sodium citrate for example), malic acid and salts thereof (sodium malate for example), tartaric acid and salts thereof (sodium tartrate for example), sodium carbonate ($Na_2CO_3$), and sodium gluconate.

When the composition comprises a superplasticiser, the latter preferably does not represent more than 4.5% by mass of the total mass of this composition whereas, when the composition comprises a setting retarder, in particular, citric acid or a salt thereof, the latter preferably does not represent more than 3.5% by mass of the total mass of said composition.

The composition may in addition comprise sand, for example of the type marketed by the company SIBELCO under the product reference CV32, in which case the sand/binder mass ratio could reach 6.

The composition typically has a W/B ratio (that is that is to say a mass ratio between the water and the binder present in the composition) ranging from 0.1 to 1, preferably from 0.2 to 0.6 and, still better, from 0.35 to 0.55.

According to the invention, the stabilization of the mercury and the encapsulation of the waste may be carried out in the same container or "conditioning container", for example a barrel type container, in which case the encapsulation of the waste comprises:

- introducing the binder and the aqueous mixing solution, together or separately, into the container in which stabilizing the mercury has been carried out and, simultaneously or successively, mixing the waste with the binder and the aqueous mixing solution, for example by means of an agitation system with one or more blade(s), until a homogeneous embedding is obtained; then
- hardening the cementitious paste in the container.

If adjuvants and/or sand are provided for, they may be introduced into the container at the same time as the binder or, if the adjuvants are soluble in water, in a form dissolved in the aqueous mixing solution.

As an alternative, the stabilization of the mercury may be carried out in a first container and the encapsulation of the waste is carried out in a second container or "conditioning container".

A number of ways of carrying out the encapsulation are thus then possible.

Thus, for example, the encapsulation of the waste may, in the first place, comprise:

- introducing the binder and the aqueous mixing solution into the second container and mixing thereof, for example by means of an agitation system with one or more blade(s), until a homogeneous cementitious paste is obtained;
- introducing the waste into the second container and, simultaneously or successively, mixing of the cementitious paste and the waste in the second container, for example by means of an agitation system with one or more blade(s), until a homogeneous embedding is obtained; then
- hardening the cementitious paste in the second container.

In which case, if adjuvants and/or sand are provided for, they are then preferably introduced into the second container at the same time as the binder and the aqueous mixing solution.

The encapsulation of the waste may, in the second place, comprise:

- introducing the binder and the waste into the second container and mixing thereof, for example by means of an agitation system with one or more blade(s), until a homogeneous mixture is obtained;
- introducing the aqueous mixing solution into the second container and mixing the binder/waste mixture with this solution, for example by means of an agitation system with one or more blade(s), until a homogeneous embedding is obtained; then
- hardening the cementitious paste.

In which case, if adjuvants and/or sand are provided for, they may then be introduced into the container at the same time as the binder or, if the adjuvants are soluble in water, in a form dissolved in the aqueous mixing solution.

In the two cases, the waste may be introduced into the second container in two forms:

- either in the form in which the waste happens to be at the end of the stabilization, that is to say in suspension in the aqueous medium in which this stabilization has occurred, in which case the quantity of water provided to the binder by the suspension is to be taken into account in the abovementioned W/B ratio;
- or in a form in which the waste has previously been freed from the aqueous medium in which the stabilization has been carried out, for example by means of filtration and, optionally, dewatering, in which case the method in addition comprises, between the stabilization of the mercury and the encapsulation of the waste, the separation of the waste from the aqueous medium in which the mercury has been stabilized.

According to the invention, the mass of the waste which is embedded in the cementitious paste may represent from 5 to 70% of the mass of the ensemble formed by the waste and this paste.

The hardening of the cementitious paste may, for example, be carried out by storage of the conditioning container at ambient temperature and under controlled hygrometry conditions.

This container is hermetically sealed, either between the embedding and the hardening, or after the hardening.

The waste may be any waste comprising mercury and may in particular be earth, rubble (for example, originating from the demolition of mercury-containing facilities), sludge (for example, originating from halogen chemistry), a technological mercury waste, that is to say, consisting of used equipment such as waste comprising batteries containing mercury (button cells, stick batteries, etc), accumulators, fluorescent tubes, low energy light bulbs, mercury thermometers, mercury barometers, mercury sphygmomanometers, tubes, absorbents, electronic cards, etc., or even a mixture of different types of mercurial waste.

The mercury present in the waste may be in a wide variety of forms prior to its stabilization: thus, it may entail mercury in the metallic state (that is, in the oxidation state 0), also referred to as "elemental mercury"; mercury in the form of mercurous or mercuric inorganic compounds such as $Hg_2Cl_2$ or calomel, $Hg_2O$, $HgCl_2$, $Hg(OH)_2$, HgO, $HgSO_4$, $HgNO_3$, $Hg(SH)_2$, HgOHSH, HgOHCl, HgClSH, etc; or mercury in the form of organomercury compounds such as mono methyl mercury compounds $CH_3Hg^+X^-$ (where $X^-$ represents any anion, for example $Cl^-$ or $NO_3^-$), often referred to by the generic term "methylmercury", or monoethyl mercury compounds $C_2H_5Hg^+X^-$ (where $X^-$ represents any anion, for example $Cl^-$ or $NO_3^-$), often referred to by the generic term "ethylmercury".

Preferably, the waste is derived from one or more nuclear facilities.

More preferably, the waste comprises mercury in the metal state.

Depending on the nature and the size of the waste to be treated, the method in addition includes a preliminary treatment for reducing the dimensions of the waste, for example a mechanical treatment such as crushing, fragmentation or the like.

In addition to the previously mentioned advantages (quantitative stabilization of mercury as mercury sulfide, absence of $H_2S$ production, high encapsulation rate), the method of the invention presents other advantages, in particular:

- the simplicity of implementation thereof;
- the absence of production of acidic aqueous effluents;
- the use of reagents that are readily available commercially and inexpensive;
- a low energy consumption; and
- the obtaining of packages that satisfy the acceptance specifications for packages containing mercury contaminated or potentially contaminated with radioelements, as established by the Agence Nationale pour la Gestion des Déchets Radioactifs (ANDRA), particularly in terms of leaching of mercury (as demonstrated in the examples here below).

Other characteristic features and advantages of the method of the invention will emerge from the additional description which follows, which relates to examples of implementation of the two steps—stabilization and encapsulation by cementation—that it comprises as well as to the presentation of the properties of the mercury sulfide thus obtained and of the materials resulting from the encapsulation of this mercury sulfide in cementitious matrices.

It goes without saying that this additional description is provided by way of illustration of the subject matter of the invention and is in no way intended to be interpreted as a limitation of this subject matter.

DETAILED DESCRIPTION OF A PARTICULAR EMBODIMENT

Example 1: Precipitation of the Mercury as Mercury Sulfide in a Basic Aqueous Sodium Thiosulfate/Sodium Sulfide Medium At ambient temperature (21±2° C.), an aqueous solution of sodium thiosulphate is prepared by dissolution of 6 g of sodium pentahydrate thiosulphate $Na_2S_2O_3.5H_2O$ in 50 ml of deionised water and then adding to this solution 2.04 g of mercury metal Hg(0), under agitation. The mercury is dispersed in the solution in the form of small droplets.

After agitation for a period of 2-3 hours, the solution becomes greyish and its pH, which was 7-8 prior to the addition of mercury, increases until reaching the value of 11-12. These modifications are due to the formation in the reaction medium of mercury thiosulfates of the type $Hg(S_2O_3)$ and/or $Hg(S_2O_3)_2^{2-}$.

After respectively 24 hours and 48 hours of agitation, 0.20 g of sodium sulfide $Na_2S.H_2O$ is added to the solution, i.e. amounting to a total of 0.40 g.

After 120 hours of agitation, the solution, which is red in colour, is filtered in order to recover all of the solid phase dispersed in this solution.

Figure 1:
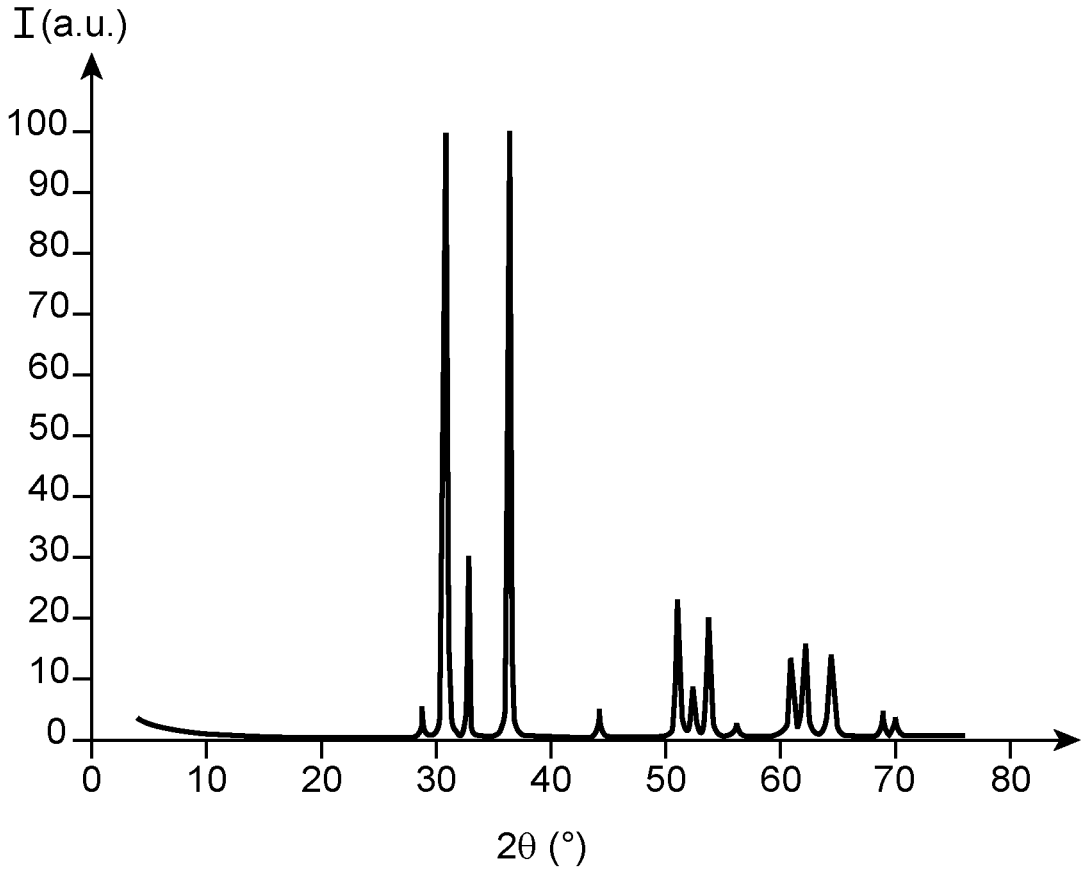
FIG. 1 illustrates X-ray diffractogram of the mercury sulfide obtained in an example of implementation of the method of the invention.

This solid phase is subjected to X-ray diffraction analysis (XRD). The diffractogram obtained, which is illustrated in FIG. 1, shows that this solid phase is constituted of particles of mercury sulfide crystallised in α or cinnabar form, denoted as α-HgS, which is more stable than the mercury sulfide crystallised in β or metacinnabar form, denoted as β-HgS.

Moreover, the optical microscopic observation of these particles shows that they measure from 5 to 10 μm.

Example 2: Encapsulation of Mercury Sulfide α-HgS in Cementitious Matrices

The mercury sulfide obtained in Example 1 here above is encapsulated in cementitious matrices which are obtained by hardening two types of mortar, respectively M1 and M2, whose composition is presented in Table I here below.

TABLE I

| Mortar | Cement | Composition | Sand/Binder (m/m) | W/B |
|---|---|---|---|---|
| M1 | Portland (CEM I) | CEM I 52.5N CP2 (HOLCIM) + sand CV32 (SIBELCO) + water | 3 | 0.50 |
| M2 | Phospho-magnesian (MKP) | MgO - DBM 90 (RICHARD BAKER HARRISON) + $KH_2PO_4$ + borax + sand CV32 (SIBELCO) + water Mass ratio $MgO/KH_2PO_4$ = 1.47 | 1 | 0.30* |

*W/B = mass ratio water/(MgO + $KH_2PO_4$ + borax)

In order to do this, the mercury sulfide is added to the mixture of the solid constituents of the mortars, at a level of 10% or 20% by mass relative to the total mass of the mortars, and then, after homogenisation, the mixing water is added. The mixing of the mortars is carried out according to the rules defined in the standards in force for the preparation of typical standard mortars for the measurements of mechanical resistance.

The setting time, as determined by means of a Vicat setting time tester according to the standard EN 196-3+A1 (Methods of testing cement. Part 3: Determination of setting times and soundness), as well as the maximum temperature reached during hydration, as determined under Langavant semi-adiabatic conditions according to the standard EN 196-9 (Methods of testing cement. Part 9: Heat of hydration—semi-adiabatic method), of the mortars thus added of mercury sulfide are shown in Table 2 here below.

By way of comparison, also indicated in this table are the Vicat setting time and the maximum hydration temperature obtained for mortars M1 and M2 free of mercury sulfide α-HgS.

TABLE 2

| Mortar | Setting time Start (min) | Setting time End (min) | Maximum hydration temperature (° C.) |
|---|---|---|---|
| M1 | 180 | 223 | 46.7 |
| M1 + 10% of α-HgS | 131 | 244 | 47.4 |
| M1 + 20% of α-HgS | 167 | 227 | 48.8 |

TABLE 2-continued

| Mortar | Setting time Start (min) | Setting time End (min) | Maximum hydration temperature (° C.) |
|---|---|---|---|
| M2 | 19 | 26 | 76.2 |
| M2 + 10% of α-HgS | 21 | 32 | 68.4 |
| M2 + 20% of α-HgS | 17 | 24 | 65.3 |

Figure 2:
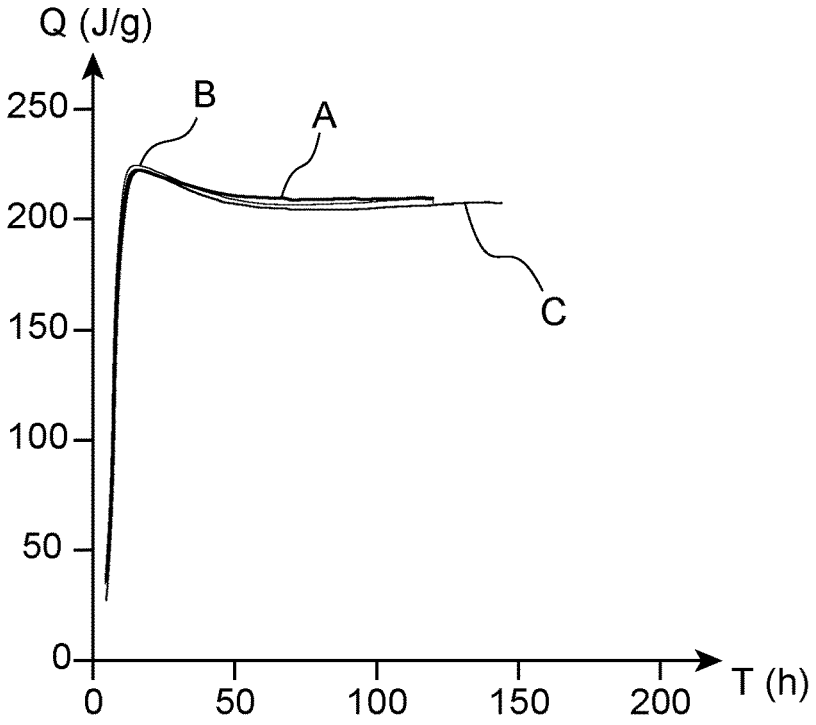
FIG. 2 illustrates the evolution of the heat of reaction (or heat of hydration), denoted as Q and expressed in J/g, as a function of the time, denoted as T and expressed in hours, of mortars based on a Portland cement CEM I, with or without the adding of mercury sulfide obtained in an example of implementation of the method of the invention; in this figure, the curves denoted as A and B correspond to two mortars to which respectively 10% and 20% by mass of this mercury sulfide have been added, while the curve denoted as C corresponds to a mortar free of said mercury sulfide.
Figure 3:
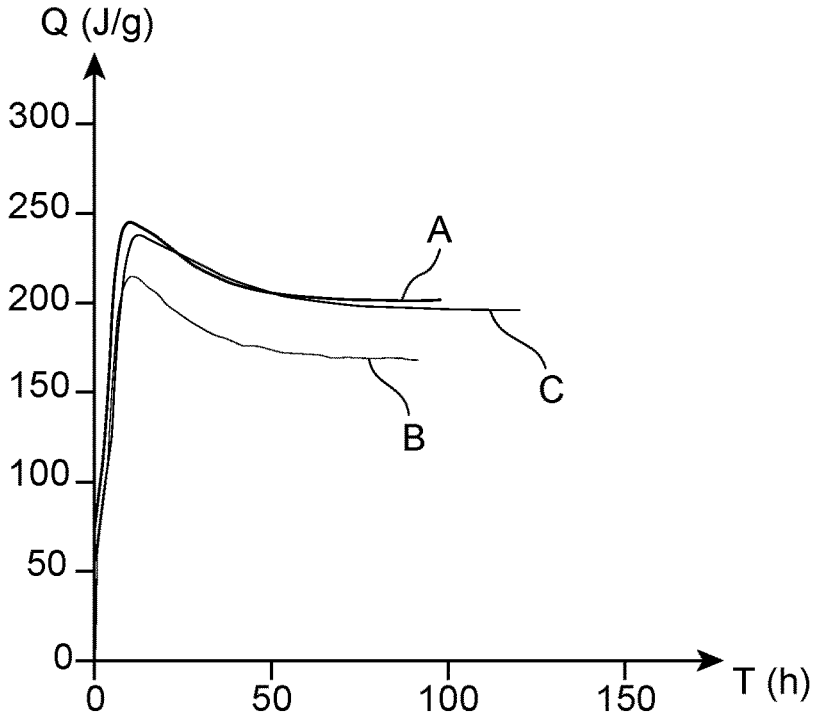
FIG. 3 illustrates the evolution of the heat of reaction (or heat of hydration), expressed in J/g, as a function of the time, denoted as T and expressed in hours, of mortars based on a phosphomagnesium cement, with or without the adding of mercury sulfide obtained in an example of implementation of the method of the invention; in this figure, the curves denoted as A and B correspond to two mortars to which respectively 10% and 20% by mass of this mercury sulfide have been added, while the curve denoted as C corresponds to a mortar free of the said mercury sulfide.

Moreover, FIGS. 2 and 3 illustrate the evolution of the heat of reaction (or heat of hydration), denoted as Q and expressed in J/g, as a function of the time, denoted as t and expressed in hours, of the various mortars, FIG. 2 corresponding to the mortars M1 (curve C), M1+10% of α-HgS (curve A) and M1+20% of α-HgS (curve B) and FIG. 3 corresponding to the mortars M2 (curve C), M2+10% of α-HgS (curve A) and M2+20% of α-HgS (curve B).

Table 2 and FIGS. 2 and 3 show that, for a given type of mortar (M1 or M2), the adding of mercury sulfide α-HgS in the mortar does not substantially modify either the setting time of this mortar or the heating up that it undergoes over the course of hydration.

The materials resulting from the hardening of the mortars M1, M1+10% of α-HgS, M1+20% of α-HgS, M2, M2+10% of α-HgS, and M2+20% of α-HgS are subjected to compressive and flexural strength tests according to the standard NF EN 196-1 (Methods of testing cement. Part 1: Determination of mechanical strength).

Figure 4:
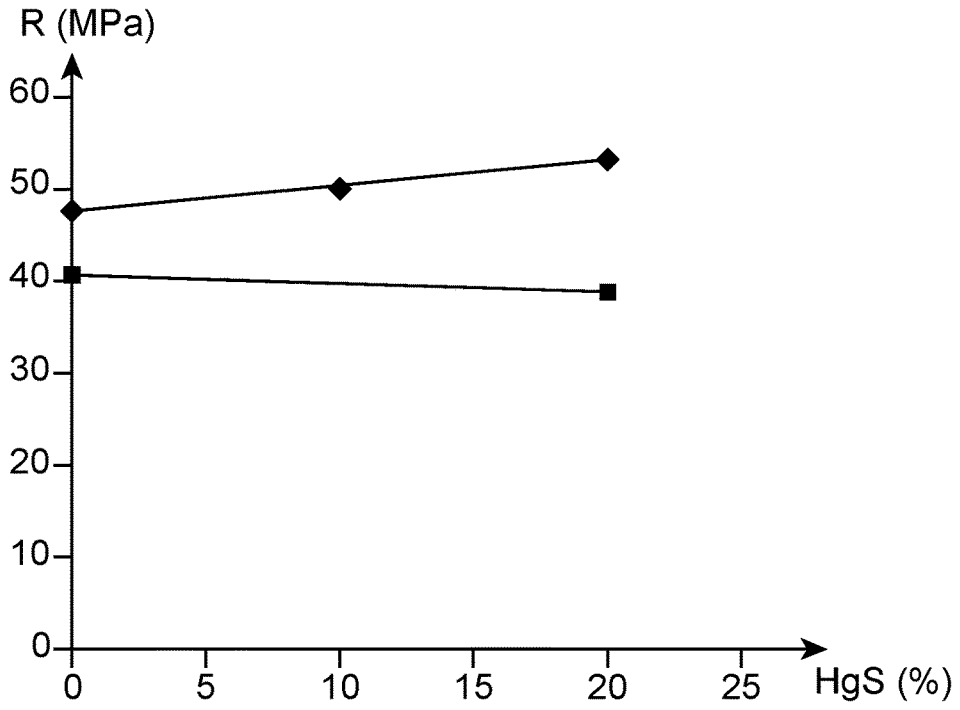
FIG. 4 illustrates the evolution of the compressive strength, denoted as R and expressed in MPa, of materials resulting from the hardening of mortars, as a function of the mercury sulphide mass content, expressed in %, of these mortars, the mercury sulphide being obtained in an example of embodiment of the method of the invention; in this figure, the symbols ♦ correspond to the materials resulting from the hardening of mortars based on Portland cement CEM I, while the symbols ■ correspond to the materials resulting from the hardening of mortars based on a phosphomagnesium cement.
Figure 5:
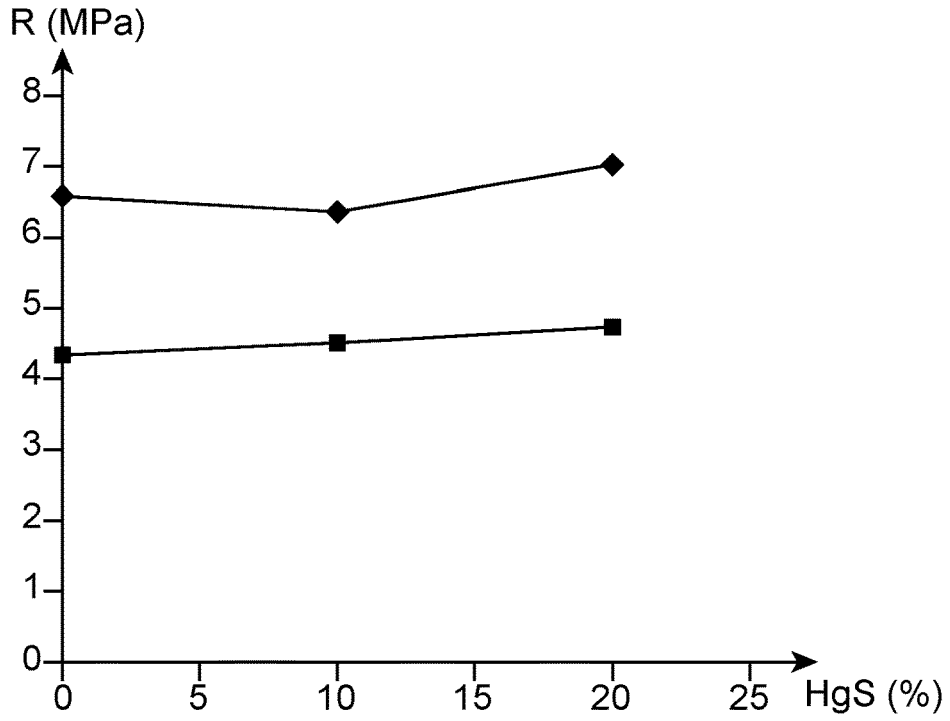
FIG. 5 illustrates the evolution of the flexural strength, denoted as R and expressed in MPa, of materials resulting from the hardening of mortars as a function of the mercury sulfide mass content, expressed in %, of these mortars, the mercury sulphide being obtained in an example of embodiment of the method of the invention; in this figure, the symbols ♦ correspond to the materials resulting from the hardening of mortars based on Portland cement CEM I, while the symbols ■ correspond to the materials resulting from the hardening of mortars based on a phosphomagnesium cement.

The results of the compressive strength tests are illustrated in FIG. 4, while the results of the flexural strength tests are shown in FIG. 5. In these figures, which show the strength obtained, denoted as Q and expressed in MPa, as a function of the mercury sulfide α-HgS mass content of the mortars of, expressed in %, the symbols ♦ correspond to the materials resulting from the hardening of the mortars M1, M1+10% of α-HgS, and M1+20% of α-HgS, while the symbols ■ correspond to the materials resulting from the hardening of the mortars M2, M2+10% of α-HgS, and M2+20% of α-HgS.

These figures show that, for a given type of mortar (M1 or M2), the adding of mercury sulfide α-HgS in the mortar does not substantially modify the mechanical properties of the material resulting from the hardening of this mortar.

The materials resulting from the hardening of the mortars M1, M1+10% of α-HgS, M1+20% of α-HgS, M2, M2+10% of α-HgS, and M2+20% of α-HgS are also subjected to leaching tests according to the standards XP CEN/TS 15862 (Leaching on monoliths) and NF EN 12457-2 (Leaching on fragments).

The main operating conditions for these tests are presented in Table 3 here below.

TABLE 3

| | Leaching on monoliths (XP CEN/TS 15862) | Leaching on fragments (NF EN 12457-2) |
|---|---|---|
| Leachate | Ultrapure water | Ultrapure water |
| Sample sizes | ≥40 mm in all directions | granularity <4 mm |
| Volume of leachate/Surface area of a sample | 12 $cm^3/cm^2$ | — |
| Volume of leachate/Mass of a sample | — | 10 L/kg |
| Time of contact of samples/leachate | 24 hours | 24 hours |

At the end of the 24 hours of leaching, the leachates are filtered on a 0.45 μm membrane filter using a vacuum filtration device and then the eluates are analysed by plasma torch atomic emission spectrometry (ICP-AES).

These analyses show that all the eluates have a mercury concentration of less than 0.01 part per million (ppm), which corresponds to maximum leaching values of 0.005 mg/kg for monolithic tests and 0.1 mg/kg for fragment tests, that is to say leaching values well below the regulatory thresholds as set by ANDRA.

REFERENCES CITED

[1] U.S. Pat. No. 6,312,499
[2] US Patent Application 2008/0234529
[3] Patent Application EP 1 751 775
[4] Patent Application EP 2 072 467
[5] Patent Application EP 2 476 649
[6] S. Chiriki, *Schriften Forschungszentrums Jülich—Reihe Energie and Umwelt/Energy and Environment* 2010, 67, 151 pages
[7] C. R. Cheeseman et al., *Waste Management* 1993, 13 (8), 545-552
[8] W. P. Hamilton and A. R. Bowers, *Waste Management* 1997, 17 (1), 25-32
[9] J. Zhang and P. Bishop, *Journal of Hazardous Materials* 2002, 92(2), 199-212
[10] X. Y. Zhang et al., *Journal of Hazardous Materials* 2009, 168 (2-3), 1575-1580
[11] M. B. Ullah, Thesis for Master of Applied Sciences 2012, University of British Columbia, 73 pages

What is claimed is:

1. A method for immobilizing a waste comprising mercury, which comprises:

stabilizing the mercury of the waste by precipitation of the mercury as mercury(II) sulfide; then encapsulating the waste by cementation, the cementation comprising embedding the waste in a cementitious paste obtained by mixing a composition comprising a powder of at least one binder with an aqueous mixing solution, the binder being a hydraulic cement, a base-activated cement or an acid-activated cement, then hardening the cementitious paste;

and in which the precipitation of the mercury as mercury (II) sulfide comprises reacting the mercury with a thiosulfate in a basic aqueous medium, under agitation and in the presence of an alkali metal sulfide, with a molar ratio of the thiosulfate to the mercury in the aqueous medium at least equal to 1.

2. The method of claim 1, in which stabilizing the mercury comprises:

preparing a suspension by dispersing the waste in an aqueous solution of the thiosulfate under agitation and maintaining the suspension under agitation until the pH of the suspension reaches a value at least equal to 11; then adding the alkali metal sulfide to the suspension under agitation and maintaining the suspension under agitation until all the mercury has precipitated as mercury sulfide.

3. The method of claim 1, in which the molar ratio of the thiosulfate to the mercury is at least equal to 2.

4. The method of claim 1, in which the molar ratio of the alkali metal sulfide to the mercury is at most equal to 1.

5. The method of claim 1, in which the thiosulfate is sodium thiosulfate or potassium thiosulfate.

6. The method of claim 1, in which the alkali metal sulfide is sodium sulfide or potassium sulfide.

7. The method of claim 1, in which stabilizing the mercury comprises:

preparing a suspension by dispersing the waste in an aqueous solution of sodium thiosulfate or potassium thiosulfate under agitation, with a molar ratio of thiosulfate to the mercury of 2 to 3, and maintaining the suspension under agitation for a period of 10 hours to 48 hours;

adding a first quantity of sodium sulfide or potassium sulfide in solid form to the suspension under agitation, the first quantity being such that the molar ratio of the sulfide to the mercury is from 0.05 to 0.15, and maintaining the suspension under agitation for a period of 10 hours to 48 hours; then adding a second quantity of sodium sulfide or potassium sulfide in solid form to the suspension under agitation, the second quantity being such that the molar ratio of the sulfide to the mercury is from 0.05 to 0.15, and maintaining the suspension under agitation for a period of 48 hours to 96 hours.

8. The method of claim 1, in which the binder is a CEM I, CEM II, CEM III or CEM V cement, a vitrified blast furnace slag, a mixture thereof or a phosphomagnesium cement.

9. The method of claim 8, in which the binder is a CEM I cement or a phosphomagnesium cement.

10. The method of claim 1, in which the composition further comprises a superplasticiser, a setting retarder, or sand.

11. The method of claim 1, in which the composition has a water/binder mass ratio of 0.2 to 1.

12. The method of claim 1, in which stabilizing the mercury and encapsulating the waste are carried out in one container and encapsulating the waste comprises:

introducing the binder and the aqueous mixing solution, together or separately, into the container in which the mercury has been stabilized, and mixing the waste with the binder and the aqueous mixing solution until a homogeneous embedding is obtained; and hardening the cementitious paste in the container.

13. The method of claim 1, in which stabilizing the mercury is carried out in a first container and encapsulating the waste is carried out in a second container.

14. The method of claim 13, in which encapsulating the waste comprises:

introducing the binder and the aqueous mixing solution into the second container and mixing thereof until a homogeneous cementitious paste is obtained;

introducing the waste into the second container and, simultaneously or successively, mixing the cementitious paste and the waste in the second container until a homogeneous embedding is obtained; then hardening the cementitious paste in the second container.

15. The method of claim 13, in which encapsulating the waste comprises:

introducing the binder and the waste into the second container and mixing thereof until a homogeneous binder/waste mixture is obtained;

introducing the aqueous mixing solution into the second container and mixing the binder/waste mixture with the aqueous mixing solution until a homogeneous embedding is obtained; then hardening the cementitious paste.

16. The method of claim 13, comprising, between stabilizing the mercury and encapsulating the waste, separating the waste from the aqueous medium in which the mercury has been stabilized.

17. The method of claim 1, in which the waste comprises earth, rubble, sludge, technological wastes or mixtures thereof.

18. The method of claim 1, in which the waste is a nuclear waste.

19. The method of claim 1, in which the waste comprises mercury in a metal state.

20. The method of claim 1, further comprising, prior to stabilizing the mercury, a treatment for reducing the dimensions of the waste.

* * * * *